US009991589B2

(12) United States Patent
Jia et al.

(10) Patent No.: US 9,991,589 B2
(45) Date of Patent: Jun. 5, 2018

(54) ANTENNA AND METHOD OF FORMING THE ANTENNA

(71) Applicant: Beken Corporation, Shanghai (CN)

(72) Inventors: Bo Jia, Shanghai (CN); Lizhen Zhu, Shanghai (CN); Qunshan Xu, Shanghai (CN)

(73) Assignee: BEKEN CORPORATION, Shanghai (CN)

( * ) Notice: Subject to any disclaimer, the term of this patent is extended or adjusted under 35 U.S.C. 154(b) by 0 days. days.

(21) Appl. No.: 14/849,579

(22) Filed: Sep. 9, 2015

(65) Prior Publication Data

US 2017/0054206 A1 Feb. 23, 2017

(30) Foreign Application Priority Data

Aug. 18, 2015 (CN) ..... 2015 1 0508884

(51) Int. Cl.
*H01Q 1/38* (2006.01)

(52) U.S. Cl.
CPC ..... *H01Q 1/38* (2013.01)

(58) Field of Classification Search
CPC ..... H01Q 1/38
USPC ..... 343/700 MS
See application file for complete search history.

(56) References Cited

U.S. PATENT DOCUMENTS

| | | | | |
|---|---|---|---|---|
| 8,587,482 | B2 | 11/2013 | Liu | |
| 2009/0267740 | A1* | 10/2009 | Pizzuto | G06Q 10/087 340/10.1 |
| 2012/0188138 | A1* | 7/2012 | Liu | H01Q 1/2283 343/776 |
| 2013/0321230 | A1* | 12/2013 | Merlin | H01Q 1/2225 343/787 |
| 2014/0104131 | A1* | 4/2014 | Blumberg, Jr. | H01Q 1/2225 343/860 |
| 2014/0262722 | A1* | 9/2014 | Haag | B29C 45/14639 200/600 |

* cited by examiner

*Primary Examiner* — Andrea Lindgren Baltzell
(74) *Attorney, Agent, or Firm* — Perkins Coie LLP

(57) ABSTRACT

The invention discloses an antenna comprising a plurality of laminated layers of radiating elements, wherein each layer of radiating elements is arranged in a zigzag pattern; a feed point connected to one of the plurality laminated layers of the radiating elements and is configured to receive a radio frequency signal; and a plated via configured to couple the plurality of laminated layers of radiating elements; wherein the radiating elements are configured to radiate the radio frequency signal.

10 Claims, 13 Drawing Sheets

| Name | Freq | Ang | Mag | RX |
|---|---|---|---|---|
| m1 | 2.4000 | 120.9038 | 0.8845 | 0.0809 + 0.5641i |
| m2 | 2.2900 | 135.2566 | 0.1085 | 0.8476 + 0.1310i |

1300

ANTENNA AND METHOD OF FORMING THE ANTENNA

CROSS REFERENCE TO RELATED APPLICATION

This application claims priority to Chinese Application No. 201510508884.6 entitled "Antenna and method of forming the antenna," filed on Aug. 18, 2015 by Beken Corporation, which is incorporated herein by reference.

TECHNICAL FIELD

The present application relates to circuits, and more particularly but not exclusively to an antenna and a method of forming an antenna.

BACKGROUND

With the minimizing of the size and cost for wireless communication device, the size of printed circuit board (PCB) in the wireless communication device also shrinks dramatically, thus the space remaining on the PCB for an antenna also shrinks. As the antenna has a length far less than a quarter-wavelength (¼λ), it may be hard for an impedance of the antenna to match an impedance of a radio frequency (RF) transceiver.

SUMMARY OF THE INVENTION

According to an embodiment of the invention, an antenna comprises a plurality of laminated layers of radiating elements, wherein each layer of radiating elements is arranged in a zigzag pattern; a feed point connected to one of the plurality laminated layers of the radiating elements and is configured to receive a radio frequency signal; and a plated via configured to couple the plurality of laminated layers of radiating elements; wherein the radiating elements are configured to radiate the radio frequency signal.

According to an embodiment of the invention, a method of forming an antenna, comprising forming a plurality of laminated layers of radiating elements on a substrate, wherein each layer of radiating elements is formed in a zigzag pattern; connecting a feed point to one of the plurality laminated layers of the radiating elements and configuring the feed point to receive a radio frequency signal; and configuring a plated via to couple the plurality of laminated layers of radiating elements; wherein the radiating elements are configured to radiate the radio frequency signal.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

Various aspects and examples of the invention will now be described. The following description provides specific details for a thorough understanding and enabling description of these examples. Those skilled in the art will understand, however, that the invention may be practiced without many of these details. Additionally, some well-known structures or functions may not be shown or described in detail, so as to avoid unnecessarily obscuring the relevant description.

Figure 1:
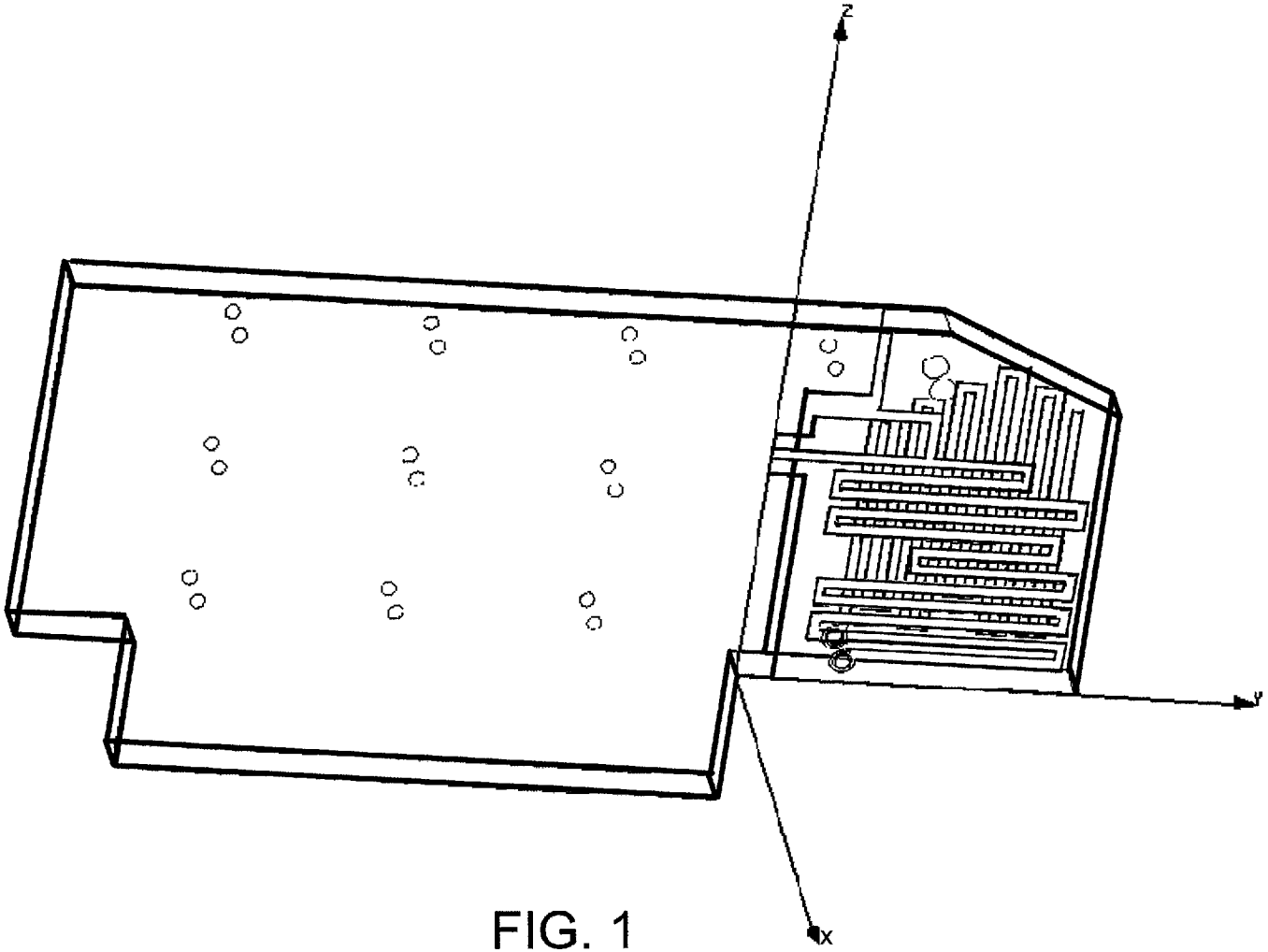
FIG. 1 is a diagram illustrating an antenna according to an embodiment of the invention.

FIG. 1 is a diagram illustrating an antenna 100 according to an embodiment of the invention. From FIG. 1 it can be seen that the radiating elements 110, 120 of the antenna 100 are laminated.

Figure 2:
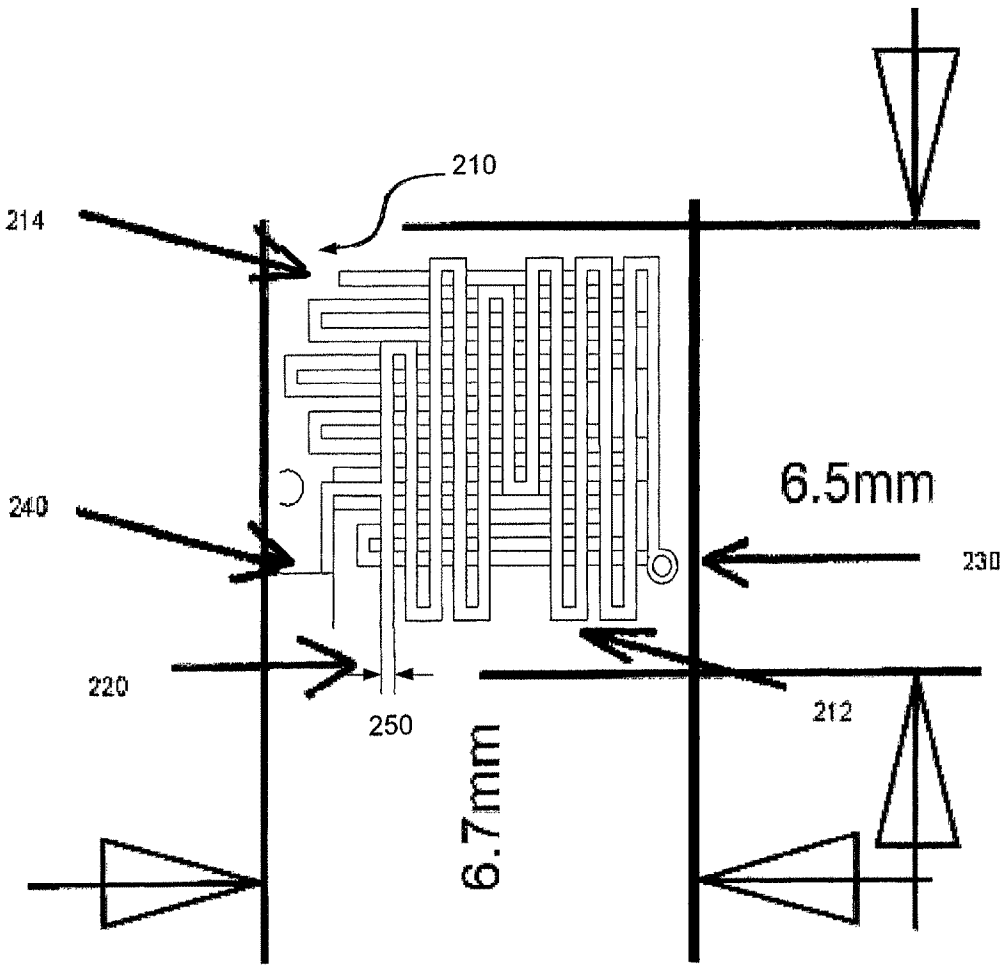
FIG. 2 is schematic diagram illustrating an equivalence of the antenna shown in FIG. 1 according to an embodiment of the invention.

FIG. 2 is schematic diagram illustrating an equivalent antenna 200 of the antenna 100 shown in FIG. 1 according to an embodiment of the invention.

The antenna 200 comprises a plurality of laminated layers of radiating elements 210, a feed point 220, a plated via 230.

Each layer of the radiating elements 210 is arranged in a zigzag pattern. In other words, each layer of the radiating elements 210 comprises a plurality of U turns. As shown in FIG. 2, there are two layers 212 and 214 of radiating elements 210. In other embodiments, layers of the radiating elements 210 may be more than two. The plurality of laminated layers of radiating elements 210 are configured to radiate the radio frequency signal. For example, the plurality of laminated layers of radiating elements 210 may be configured to radiate the radio frequency signal to the air.

The feed point 220 is connected to one of the plurality laminated layers of the radiating elements. The feed point 220 is configured to receive a radio frequency signal. The feed point 220 is an input and output point for the antenna signal. The feed point 220 may be connected to a transceiver through a transmission line or a transmission line with impedance matching network. Note a first layer 212 of radiation elements 210 may be a top layer, and a second layer 214 of the radiation element 210 may be a bottom layer. Note the bottom layer 214 of radiation elements 210 is closer to the PCB than the top layer 212 of radiation elements 210. The feed point 220 may be connected to the top layer 212 of the radiation elements 210. Alternatively, the feed point 220 may be connected to the bottom layer 214' (not shown in FIG. 2) if the radiation elements 210 are mirrored. In other words, sides of the radiating elements are flipped, the original top layer 212 is formed as the bottom layer 214', and the original bottom layer 214 is formed as the top layer 212'.

The plated via 230 is configured to couple the plurality of laminated layers of radiating elements 210. For example, the via 230 may comprise two pads in corresponding positions on different layers of the board that are electrically connected by a hole through the board. The hole is made conductive, for example, by electroplating, or is lined with a tube or a rivet. Note the plated via is formed once without special manual operation.

Alternatively, the plurality of laminated layers of radiating elements 210 comprises the first layer 212 of radiating element, such as the top layer 212, and the second layer 214 of radiating element, such as the bottom layer 214. An overlapping area of the first layer 212 and the second layer 214 is configured to be adjusted according to an impedance matching requirement. Note since the antenna is a radiating element, matching of antenna with ports of transceiver is equivalent to matching the transceiver to the atmosphere impedance.

Alternatively, a length of at least one of the first layer 212 of radiating element and the second layer 214 of radiating element is configured to be adjustable so as to adjust the overlapping area of the first layer and the second layer, or to adjust a trace width of at least one of the first layer of radiating element and the second layer of radiating element. The trace width of the first layer 212 is shown as 250 in FIG. 2. For example, the length of only one of the first layer 212 of radiating element or the second layer 214 of radiating element may be adjusted. Alternatively, lengths of both the first layer 212 of radiating element and the second layer 214 of radiating element may be adjusted.

Alternatively, the first layer 212 of radiating elements is substantially perpendicular to the second layer 214 of the radiating element. For example, as shown in FIG. 2, a majority of length of the first layer 212 of the radiating element is arranged in the vertical direction, whereas a majority of length of the first layer 214 of the radiating element is arranged in the horizontal direction. Further, the dimensions of the antenna, such as 6.5 mm in length and 6.7 mm in width shown in FIG. 2, are only illustrative. Those of ordinary skill in the art may make variations to the dimensions of the antenna according to practical application.

Alternatively, there may be an angle other than the right angle between the first layer 212 of radiating element and the second layer 214 of radiating elements. Note an equivalent capacitance may be determined by the overlapping area of the first layer 212 of radiating element and the second layer 214 of radiating elements.

FIG. 2 further shows a grounding point 240. The grounding point 240 is connected to one of the first layer 212 of radiating element or the second layer 214 of radiating element. In the embodiment shown in FIG. 2, the grounding point 240 is connected to the first layer 212 of radiating element. When there is a grounding point in the antenna, the antenna is also called a Planar Inverted-F Antenna (PIFA) antenna. Note the grounding point 240 is optional. When the grounding point 240 is omitted, the antenna is without a grounding point, which is called a monopole antenna.

Figure 3:
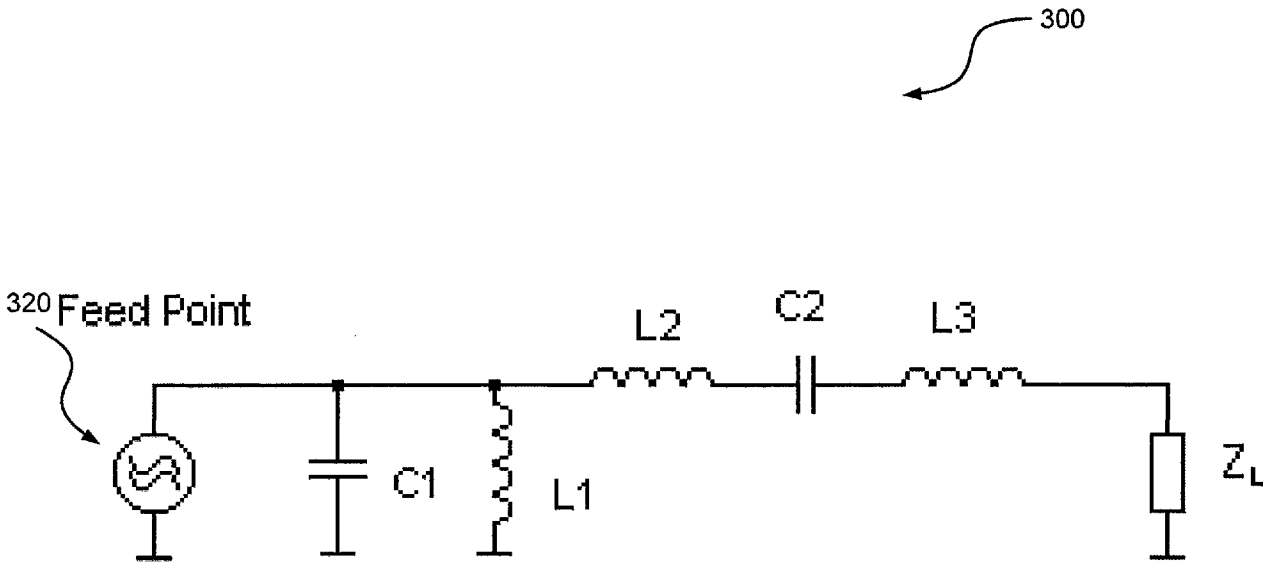
FIG. 3 is a diagram illustrating an equivalent circuit of the antenna shown in FIG. 2 according to an embodiment of the invention.

FIG. 3 is a diagram illustrating an equivalent circuit 300 of the antenna shown in FIG. 2 according to an embodiment of the invention. As shown in FIG. 3, the circuit 300 comprises a feed point 320, a first capacitor C1, a second capacitor C2, a first inductor L1, a second inductor L2, a third inductor L3, and an atmosphere impedance $Z_L$. The first capacitor C1 and the first inductor L1 are respectively equivalent capacitance and inductance for grounding point 240 shown in FIG. 2. The second capacitor C2 is an equivalent capacitance to the overlapped part of the first layer 212 of radiating element and the second layer 214 of radiating element. The second inductor L2 is an equivalent inductance of the first layer 212 of radiating element shown in FIG. 2. The third inductor L3 is an equivalent inductance of the second layer 214 of radiating element shown in FIG. 2. The atmosphere impedance $Z_L$ may be 376.7 ohm (Ω). Note Zo=μoX Co, wherein Zo represents impedance of a free space, which equals permeability of vacuum μo multiplied by Co, which represents electromagnetic wave transmission speed in vacuum, that is light speed. Accordingly, Zo equals approximate 376.73031 ohm.

Figure 4:
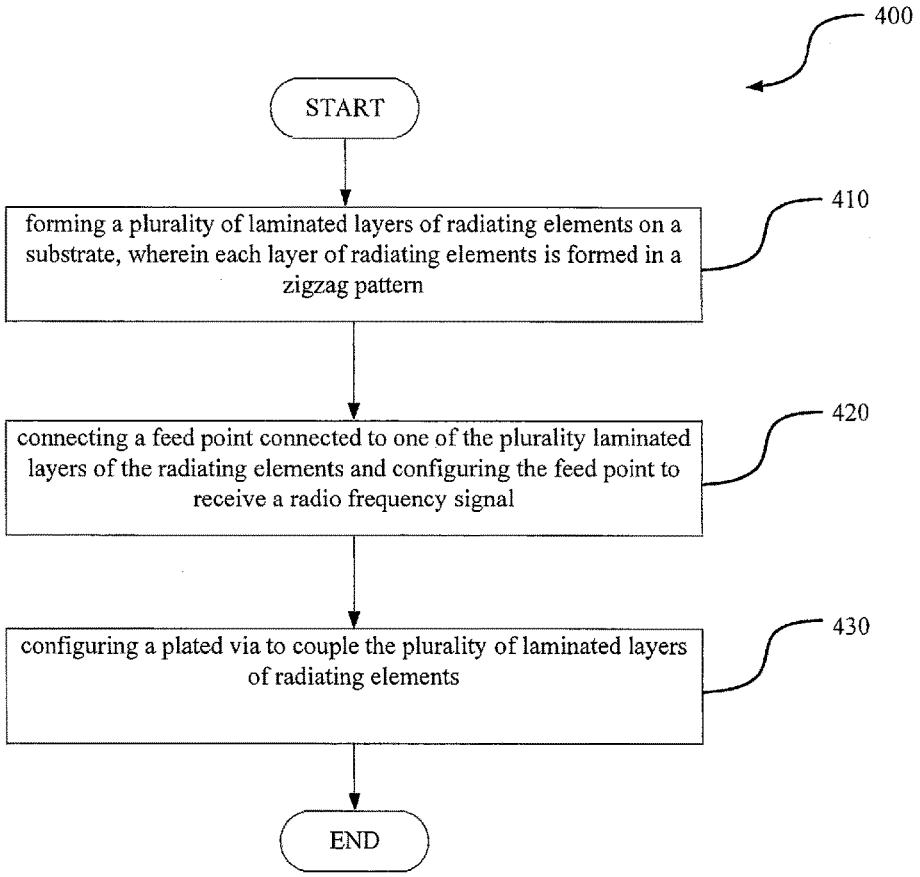
FIG. 4 is a flow chart illustrating a method of forming the antenna according to an embodiment of the invention.

FIG. 4 is a flow chart illustrating a method 400 of forming the antenna according to an embodiment of the invention.

The method 400 of forming an antenna comprises forming, in block 410, a plurality of laminated layers of radiating elements on a substrate, wherein each layer of radiating elements is formed in a zigzag pattern; connecting, in block 420, a feed point to one of the plurality laminated layers of the radiating elements and configuring the feed point to receive a radio frequency signal; and configuring, in block 430, a plated via to couple the plurality of laminated layers of radiating elements; wherein the radiating elements are configured to radiate the radio frequency signal. Note when different substrate is used, the dimension of antenna may be varied. In different substrate, wavelength of electromagnetic wave varies, which can be represented as $$\lambda = \frac{\lambda o}{\sqrt{\xi}},$$

wherein λo equals the wavelength of electromagnetic wave in the air, and ξ represents dielectric constant.

Figure 5:
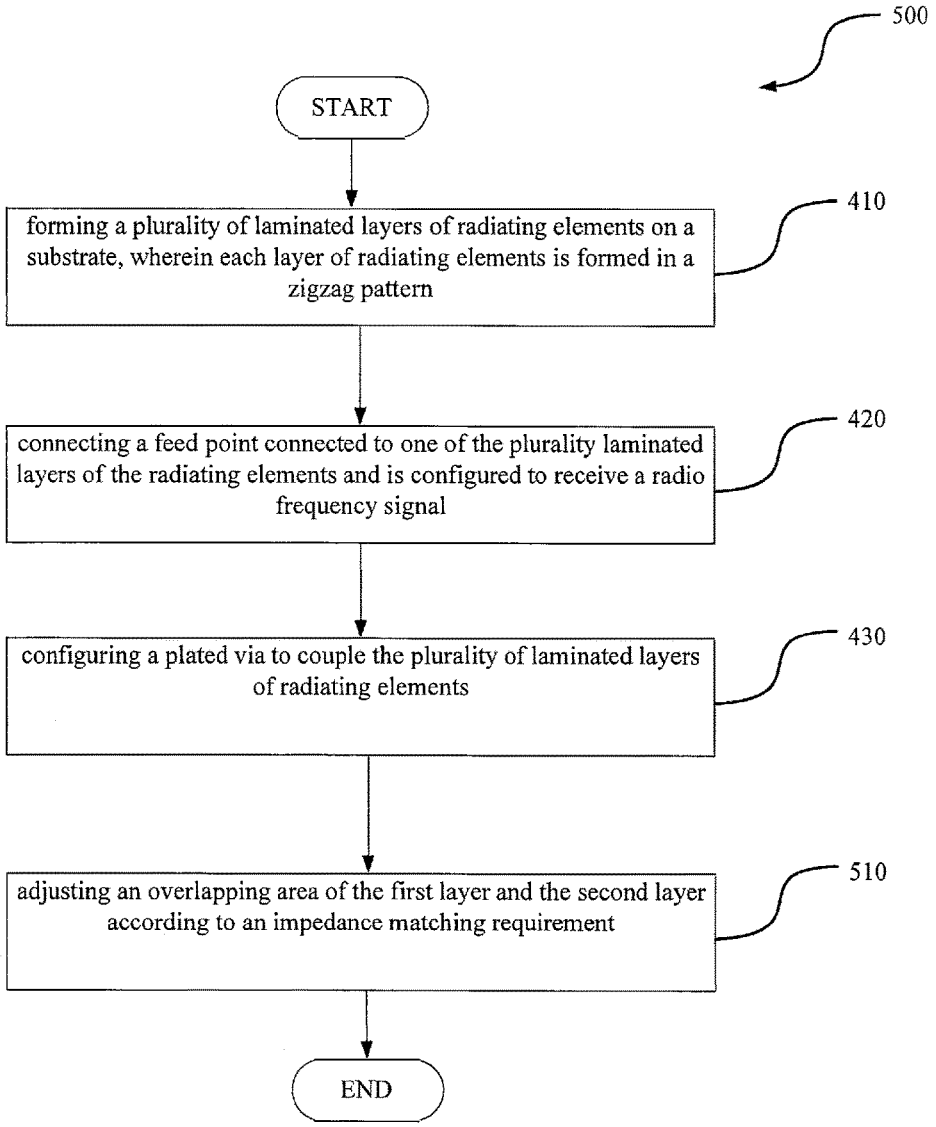
FIG. 5 is a flow chart illustrating a method of forming the antenna according to another embodiment of the invention.

FIG. 5 is a flow chart illustrating a method 500 of forming the antenna according to an embodiment of the invention. Alternatively, the plurality of laminated layers of radiating elements comprises a first layer of radiating element and a second layer of radiating element. In addition to the blocks 410, 420 and 430 already discussed with reference to the above FIG. 4, the method 500 further comprises adjusting, in block 510, an overlapping area of the first layer and the second layer according to an impedance matching requirement. Impedance matching requirement may include but be not limited to that signal source (for example, transceiver) can be radiated to the free space via an antenna, and the radiation and decay are reduced to their minimum. In high frequency transmission, a 50 ohm impedance of high-frequency transmission line has the minimum reflection, therefore impedance for transceiver ports are designed to be 50 ohm or reach 50 ohm by using matching element. Accordingly, a feed point needs to be designed as 50 ohm in order to match the transceiver. The impedance matching requirement may include a predetermined target value of impedance of the antenna, such as 50 ohm. Alternatively, adjusting the overlapping area of the first layer and the second layer according to the impedance matching requirement further comprises increasing the overlapping area of the first layer and the second layer if a capacitance of the antenna needs to be increased, or reducing the overlapping area of the first layer and the second layer if the capacitance of the antenna needs to be reduced.

Alternatively, adjusting, in block 510, the overlapping area of the first layer and the second layer is implemented by adjusting a length of at least one of the first layer 212 of radiating element and the second layer 214 of radiating element, or by adjusting a trace width of at least one of the first layer 212 of radiating element and the second layer 214 of radiating element, as shown in FIG. 2.

Alternatively, the first layer of radiating elements is substantially perpendicular to the second layer of the radiating element.

Figure 6:
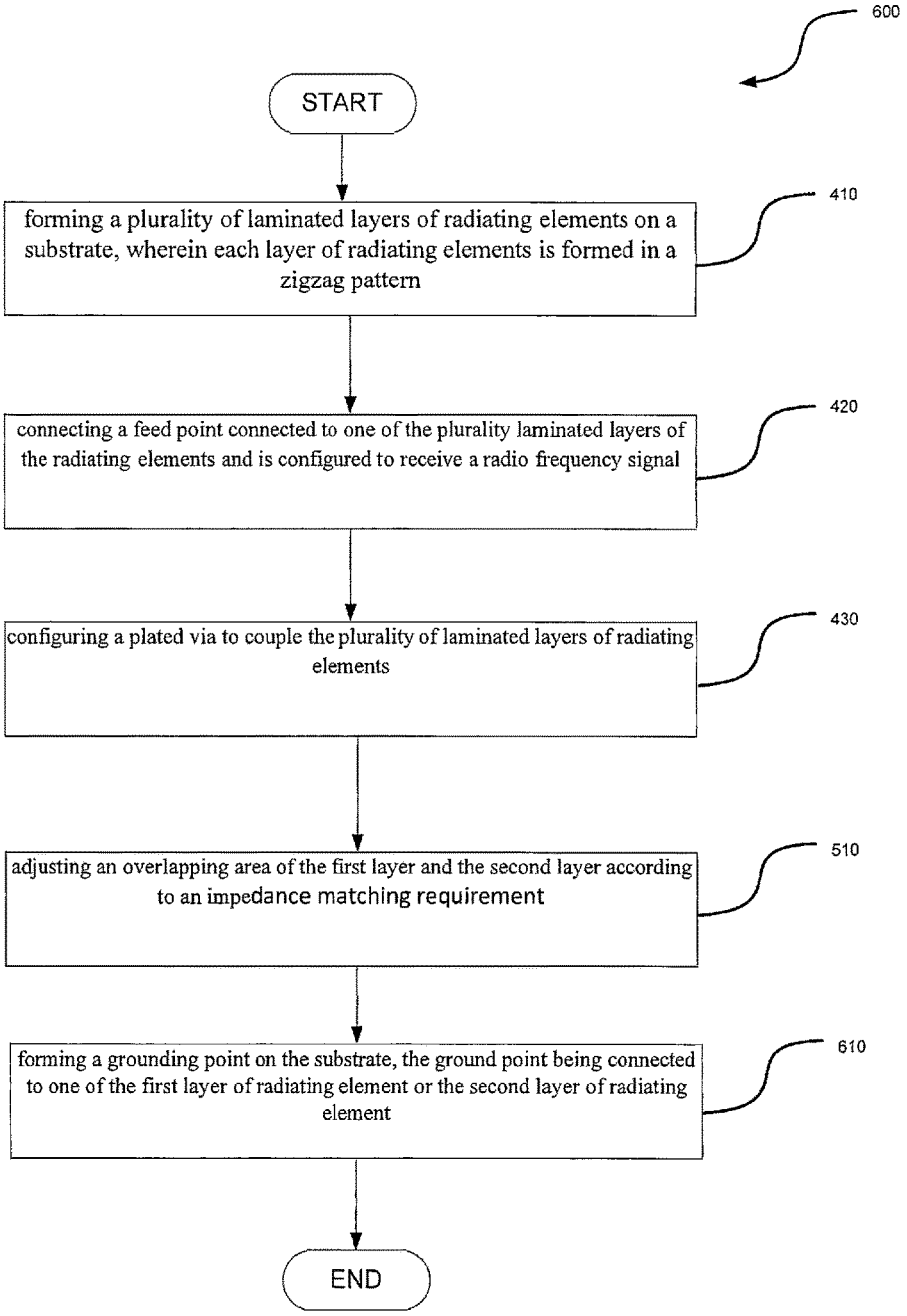
FIG. 6 is a flow chart illustrating a method of forming the antenna according to another embodiment of the invention.

FIG. 6 is a flow chart illustrating a method 600 of forming the antenna according to an embodiment of the invention. In addition to the blocks 410, 420, 430 and 510 already discussed with reference to the above FIGS. 4 and 5, the method 600 further comprises, forming, in block 610, a grounding point on the substrate, the ground point being connected to one of the first layer 212 of radiating element or the second layer 214 of radiating element, as shown in FIG. 2.

Figure 7:
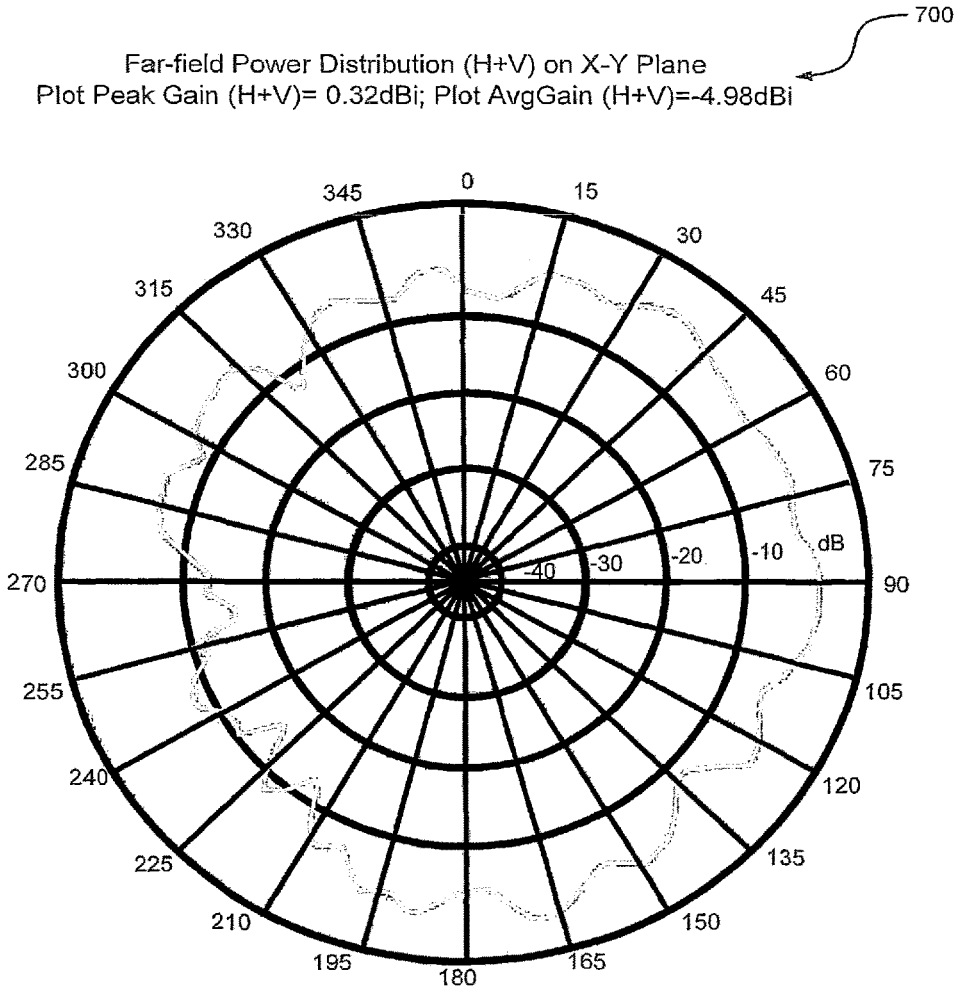
FIG. 7 is a radiation pattern chart on X-Y plane according to an embodiment of the invention.

FIG. 7 is a radiation pattern chart 700 on X-Y plane of an antenna according to an embodiment of the invention. FIG. 7 is a far-field power distribution (H+V) on X-Y plane after adjustment with the antenna structure shown in FIG. 12. In FIG. 7, the plotted peak Gain (H+V)=0.32 dBi, and plotted average gain (H+V)=−4.98 dBi. dBi, which means dB(isotropic), is the forward gain of an antenna compared with the hypothetical isotropic antenna, which uniformly distributes energy in all directions. In H+V, H represents Horizontal, and V represents vertical.

Figure 8:
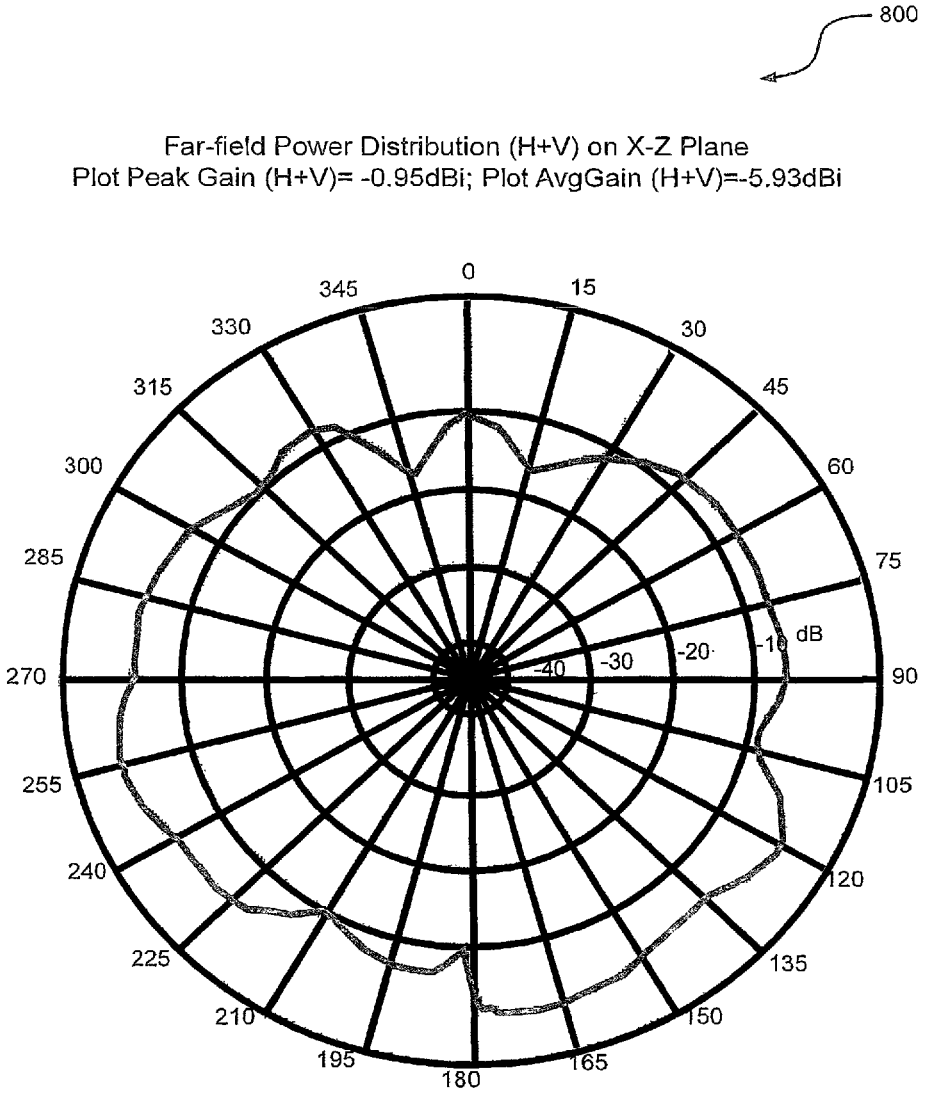
FIG. 8 is a radiation pattern chart on X-Z plane according to an embodiment of the invention.

FIG. 8 is a radiation pattern chart 800 on X-Z plane of an antenna according to an embodiment of the invention. FIG. 8 is a far-field power distribution (H+V) on X-Z plane after adjustment with the antenna structure shown in FIG. 12. In FIG. 8, the plotted peak Gain (H+V)=−0.95 dBi, and plotted average gain (H+V)=−5.93 dBi. dBi, which means dB(isotropic), is the forward gain of an antenna compared with the hypothetical isotropic antenna, which uniformly distributes energy in all directions. In H+V, H represents Horizontal, and V represents vertical.

Figure 9:
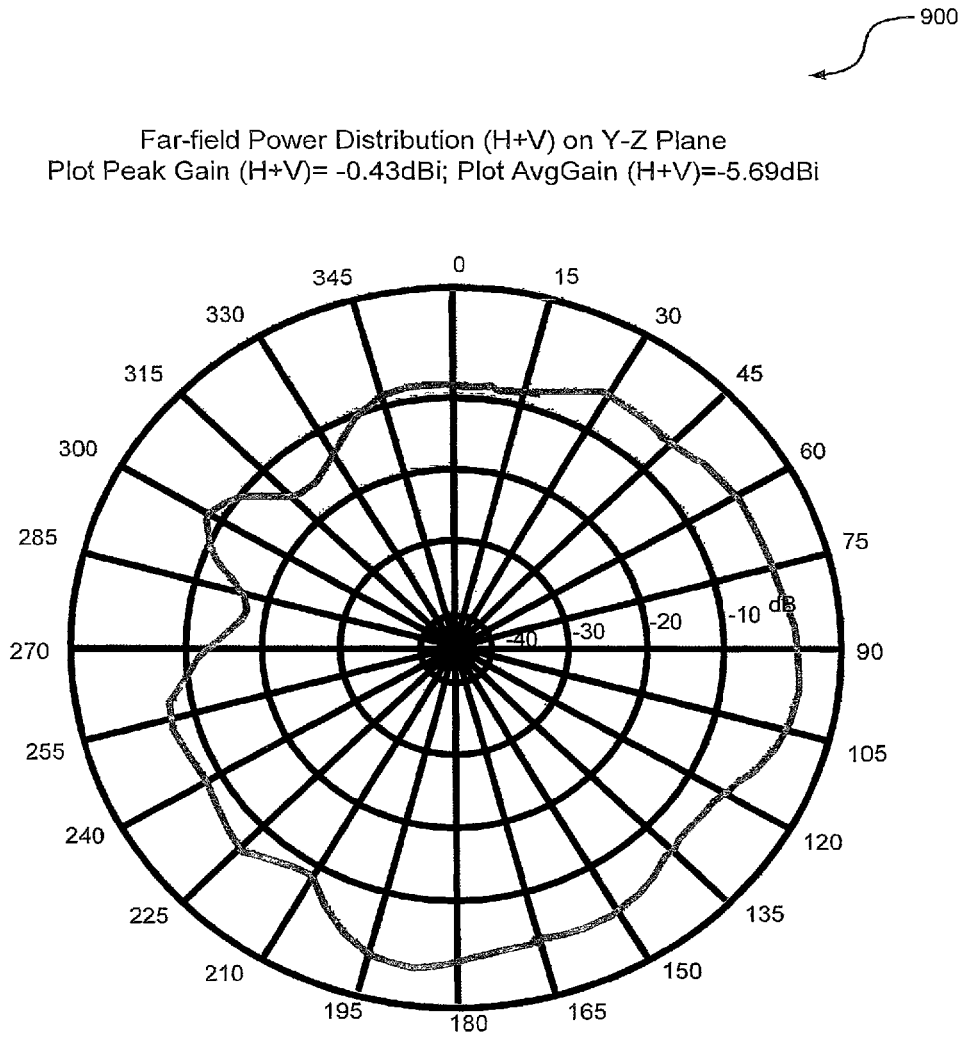
FIG. 9 is a radiation pattern chart on Y-Z plane according to an embodiment of the invention.

FIG. 9 is a radiation pattern chart 900 on Y-Z plane of an antenna according to an embodiment of the invention. FIG. 9 is a far-field power distribution (H+V) on Y-Z plane after adjustment with the antenna structure shown in FIG. 12. In FIG. 9, the plotted peak Gain (H+V)=−0.43 dBi, and plotted average gain (H+V)=−5.69 dBi. dBi, which means dB(isotropic), is the forward gain of an antenna compared with the hypothetical isotropic antenna, which uniformly distributes energy in all directions. In H+V, H represents Horizontal, and V represents vertical.

Figure 10:
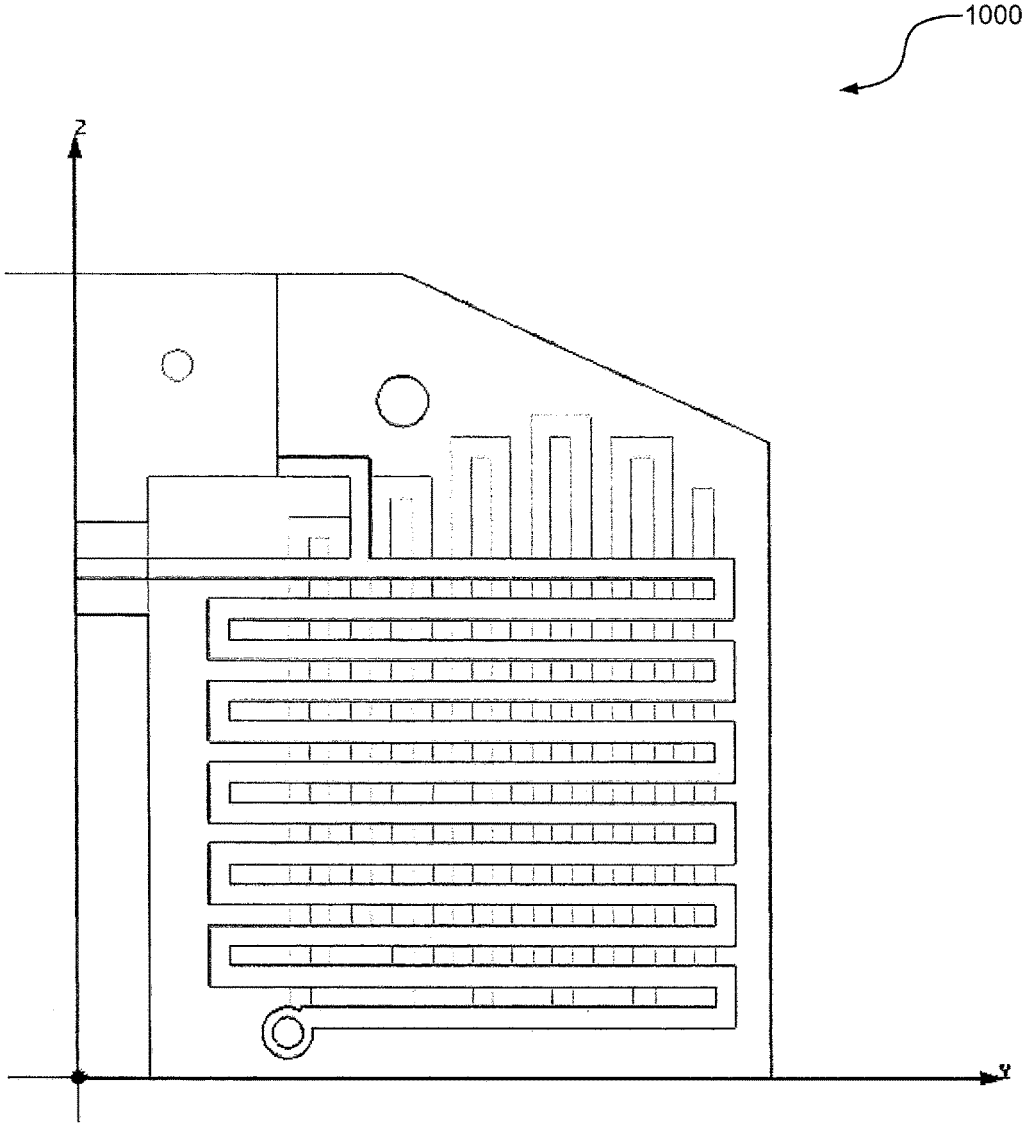
FIG. 10 is a diagram illustrating an insert piece including the antenna according to an embodiment of the invention.

FIG. 10 is a diagram illustrating an insert piece 1000 including the antenna 100 according to an embodiment of the invention. As shown in FIG. 10, a plurality of U turns of the horizontally extended radiating elements on the top layer turn at a substantial same leftmost location and rightmost location horizontally.

Figure 11:
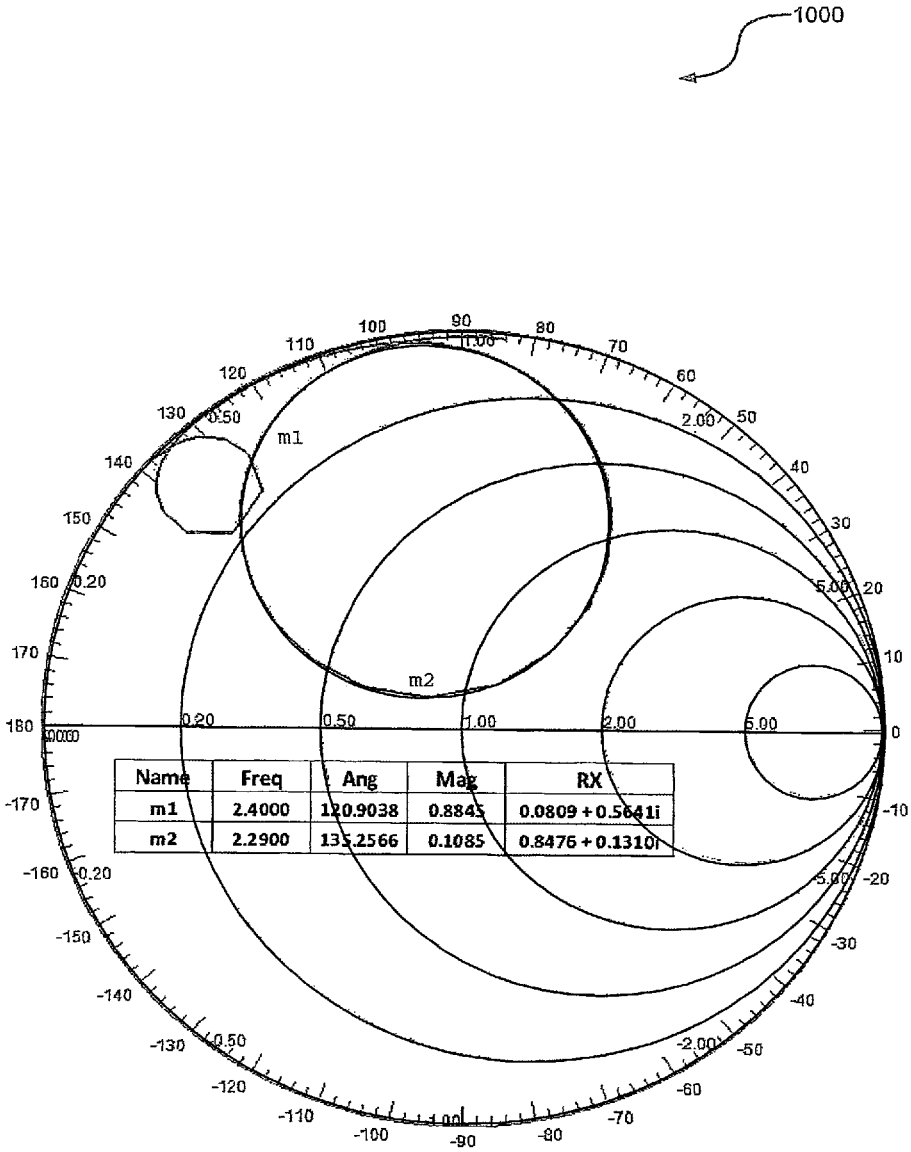
FIG. 11 is an impedance Smith chart for the antenna shown in FIG. 10 according to an embodiment of the invention.

FIG. 11 is an impedance Smith chart 1100 for the antenna shown in FIG. 10 according to an embodiment of the invention. In FIG. 11, points on a same circle has same resistance (real part), where the center of the largest circle, which is marked as 1 is the impedance matched, which equals to 50 ohm. The leftmost point of the largest circle represents short circuit, and the rightmost point of the largest circle represents open circuit. In FIG. 11, a point m2 is the nearest point to 50 ohm, which is resonate at 2.29 GHz. Note point m1, which is 2.4 GHz, is not a resonance frequency.

Figure 12:
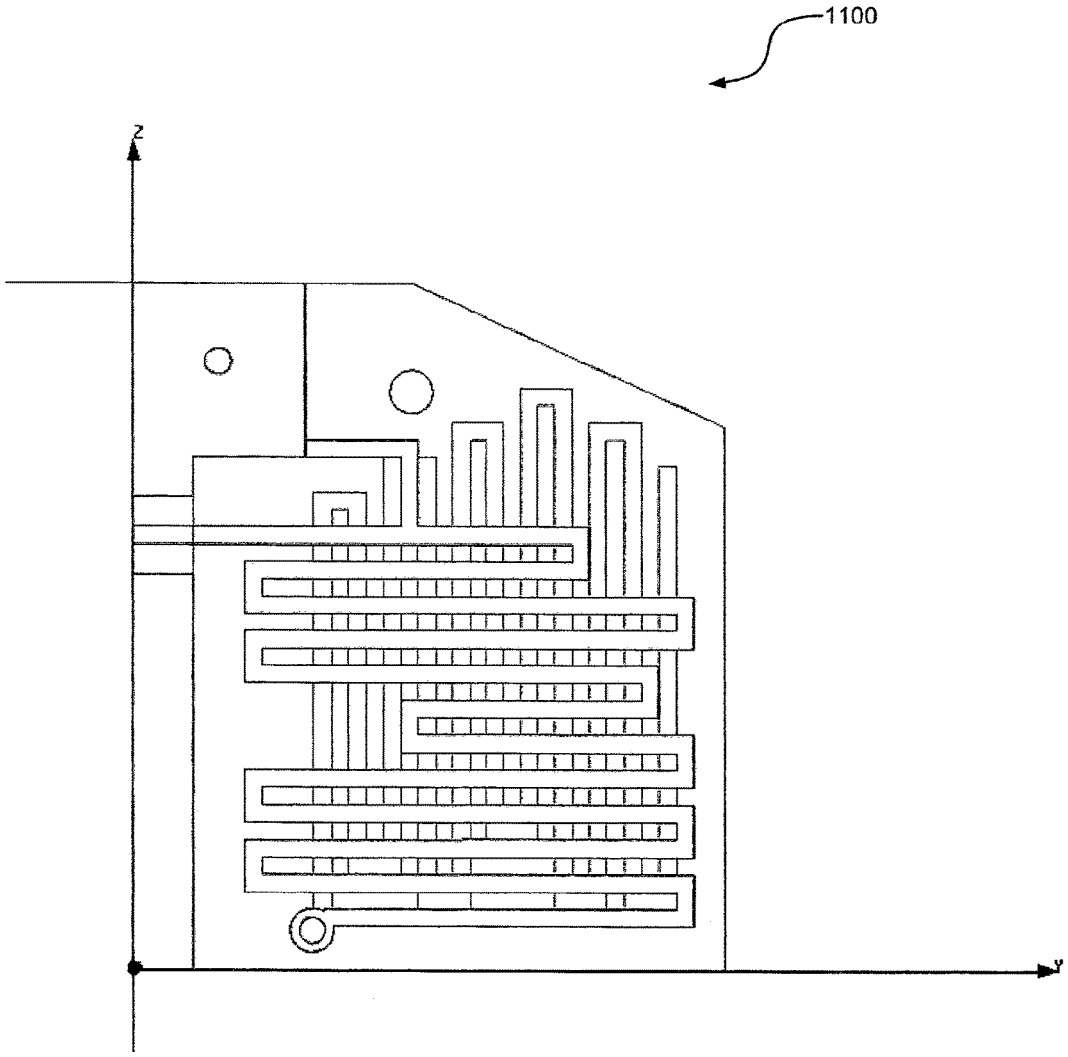
FIG. 12 is a diagram illustrating an insert piece including the antenna according to another embodiment of the invention.

FIG. 12 is a diagram illustrating an insert piece 1200 including the antenna according to another embodiment of the invention. Compared with the insert piece 1000 shown in FIG. 10, the first U turn on the right, the third U turn on the right, and the third U turn on the left of the top layer of radiating elements shown in FIG. 12 are indented with respect to the corresponding top layer of radiating elements shown in FIG. 10. As the overlapping area of the top layer and the bottom layer of the radiating elements is reduced for the antenna shown in FIG. 12 with respect to the antenna shown in FIG. 10, the capacitance of the antenna in FIG. 12 is reduced with respect to the capacitance of the antenna in FIG. 10. Further, as the length of the top layer of the radiating elements in FIG. 12 is reduced with respect to the top layer of the radiating elements shown in FIG. 10, an equivalent inductance for top layer radiating element is reduced, thus the inductance of the antenna also reduced for the antenna shown in FIG. 12 with respect to the antenna shown in FIG. 10. Further, although FIG. 12 only shows that the length of top layer of radiating elements is adjusted, the length of only the bottom layer of radiating elements, or the lengths of both the top layer and the bottom layer of radiating elements may be adjusted.

Figure 13:
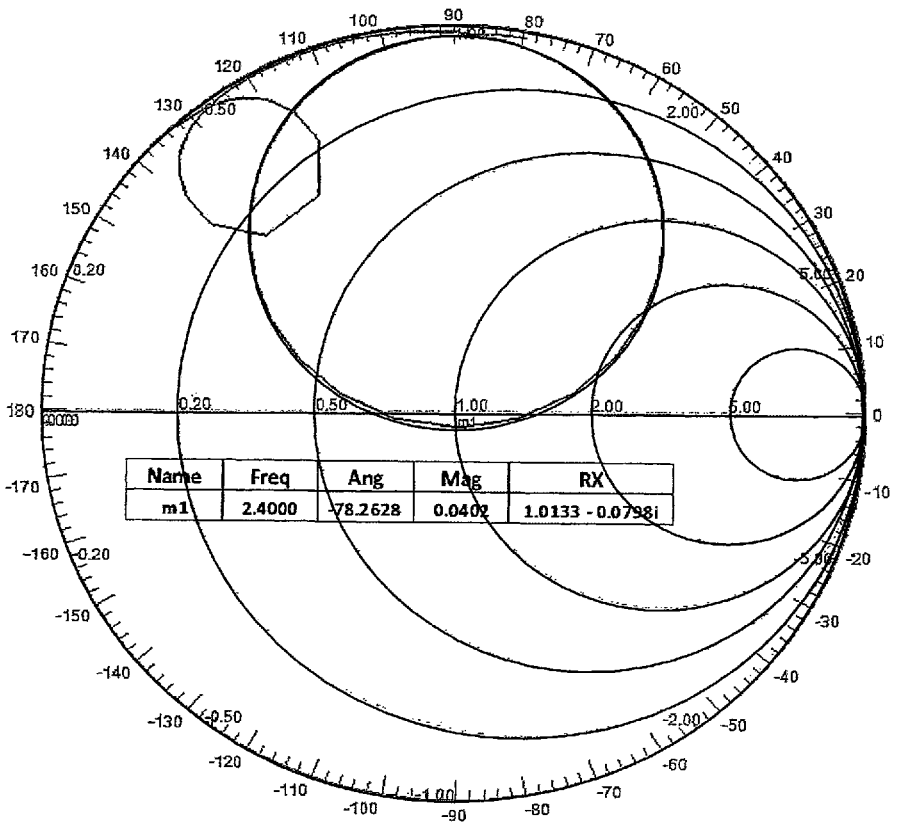
FIG. 13 is an impedance Smith chart for the antenna shown in FIG. 12 according to an embodiment of the invention.

FIG. 13 is an impedance Smith chart 1300 for the antenna shown in FIG. 12 according to an embodiment of the invention. Compared with FIG. 11, it can be clearly seen that the point m2, which is at 2.4 GHz, becomes a resonance frequency, since it is nearest to the matching impedance 50 ohm. Referring back to FIGS. 12 and 3, by adjusting overlapping area of top layer and bottom layer of radiating elements, and by adjusting a length of the top layer of radiating elements, it is equivalent to adjusting L2, C2, and L3 in FIG. 3, therefore impedance matching may be obtained.

It should be appreciated by those skilled in the art that components from different embodiments may be combined to yield another technical solution. This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Although the present invention has been described with reference to specific exemplary embodiments, the present invention is not limited to the embodiments described herein, and it can be implemented in form of modifications or alterations without deviating from the spirit and scope of the appended claims. Accordingly, the description and the drawings are to be regarded in an illustrative rather than a restrictive sense.

From the foregoing, it will be appreciated that specific embodiments of the technology have been described herein for purposes of illustration, however various modifications can be made without deviating from the spirit and scope of the present invention. Accordingly, the present invention is not restricted except in the spirit of the appended claims.

Other variations to the disclosed embodiments can be understood and effected by those skilled in the art in practicing the claimed invention, from a study of the drawings, the disclosure, and the appended claims. In the claims the word "comprising" does not exclude other elements or steps, and the indefinite article "a" or "an" does not exclude a plurality. Even if particular features are recited in different dependent claims, the present invention also relates to the embodiments including all these features. Any reference signs in the claims should not be construed as limiting the scope.

Features and aspects of various embodiments may be integrated into other embodiments, and embodiments illustrated in this document may be implemented without all of the features or aspects illustrated or described. One skilled in the art will appreciate that although specific examples and embodiments of the system and methods have been described for purposes of illustration, various modifications can be made without deviating from the spirit and scope of the present invention. Moreover, features of one embodiment may be incorporated into other embodiments, even where those features are not described together in a single embodiment within the present document. Accordingly, the invention is described by the appended claims.

What is claimed is:

1. A far field antenna comprising:

a plurality of laminated layers of radiating elements, wherein each layer of radiating elements is arranged in a non-loop and zigzag pattern;

a feed point connected to one of the plurality laminated layers of the radiating elements and is configured to receive a radio frequency signal; and a plated via configured to couple the plurality of laminated layers of radiating elements;

wherein the radiating elements are configured to radiate the radio frequency signal;

wherein the plurality of laminated layers of radiating elements comprises a first layer of radiating element and a second layer of radiating element, wherein a perpendicular overlapping area of the first layer and the second layer is configured to be adjusted according to an impedance matching requirement so as to reach 50 ohm impedance.

2. The antenna of claim 1, wherein a length of at least one of the first layer of radiating element and the second layer of radiating element is configured to be adjustable so as to adjust the overlapping area of the first layer and the second layer, or to adjust a trace width of at least one of the first layer of radiating element and the second layer of radiating element.

3. The antenna of claim 1, wherein the radiating element in the first layer is substantially perpendicular to the radiating element in the second layer overlapped by the first layer.

4. The antenna of claim 1, further comprising a grounding point connected to one of the first layer of radiating element or the second layer of radiating element.

5. A method, comprising:

forming a plurality of laminated layers of radiating elements on a substrate, wherein each layer of radiating elements is formed in a zigzag pattern, wherein the zigzag pattern comprises a plurality of U turns;

connecting a feed point to one of the plurality laminated layers of the radiating elements and configuring the feed point to receive a radio frequency signal; and configuring a plated via to couple the plurality of laminated layers of radiating elements;

wherein the radiating elements are configured to radiate the radio frequency signal;

wherein the plurality of laminated layers of radiating elements comprises a first layer of radiating element and a second layer of radiating element, the method further comprises adjusting a perpendicular overlapping area of the first layer and the second layer according to an impedance matching requirement.

6. The method of claim 5, wherein adjusting the overlapping area of the first layer and the second layer according to the impedance matching requirement further comprises increasing the overlapping area of the first layer and the second layer if a capacitance of the antenna needs to be increased, or reducing the overlapping area of the first layer and the second layer if the capacitance of the antenna needs to be reduced.

7. The method of claim 5, wherein adjusting the overlapping area of the first layer and the second layer is implemented by adjusting a length of at least one of the first layer of radiating element and the second layer of radiating element, or by adjusting a trace width of at least one of the first layer of radiating element and the second layer of radiating element.

8. The method of claim 5, wherein the first layer of radiating elements is substantially perpendicular to the second layer of the radiating element.

9. The method of claim 5, further comprising forming a grounding point on the substrate, the ground point being connected to one of the first layer of radiating element or the second layer of radiating element.

10. An omnidirectional far field antenna comprising:

a plurality of laminated layers of radiating elements, wherein each layer of radiating elements is arranged in a zigzag pattern;

a feed point connected to one of the plurality laminated layers of the radiating elements and is configured to receive a radio frequency signal; and a plated via configured to couple the plurality of laminated layers of radiating elements;

wherein the radiating elements are configured to radiate the radio frequency signal, and the antenna operates at about 2.4 GHz;

wherein the plurality of laminated layers of radiating elements comprises a first layer of radiating element and a second layer of radiating element, wherein a perpendicular overlapping area of the first layer and the second layer is larger than both an non-overlapping area of the first layer and an non-overlapping of the second layer.

* * * * *